US007458767B2

(12) United States Patent
Wu et al.

(10) Patent No.: US 7,458,767 B2
(45) Date of Patent: Dec. 2, 2008

(54) COOLING FAN ASSEMBLY FOR ELECTRIC APPARATUS

(75) Inventors: Kuo-Hsien Wu, Tu-Cheng (TW); Chang-Hsu Yen, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 440 days.

(21) Appl. No.: 11/305,366

(22) Filed: Dec. 16, 2005

(65) Prior Publication Data

US 2006/0280601 A1 Dec. 14, 2006

(30) Foreign Application Priority Data

Jun. 10, 2005 (TW) ..... 94119199 A

(51) Int. Cl.
*F01D 1/02* (2006.01)

(52) U.S. Cl. ..... 415/60; 415/204; 415/206

(58) Field of Classification Search ..... 415/60, 415/203, 204, 206
See application file for complete search history.

(56) References Cited

U.S. PATENT DOCUMENTS 3,017,848 A * 1/1962 Bishop ..... 440/38
3,147,957 A * 9/1964 Martin ..... 366/263
3,150,816 A * 9/1964 Nikolaus ..... 415/53.1
3,768,920 A * 10/1973 Gerwin ..... 415/148
5,934,368 A * 8/1999 Tanaka et al. ..... 165/233
6,396,689 B1 5/2002 Yu et al.
6,923,619 B2 * 8/2005 Fedoseyev et al. ..... 415/176

FOREIGN PATENT DOCUMENTS

CN ZL200420004291.3 5/2005

* cited by examiner

*Primary Examiner*—Igor Kershteyn
(74) *Attorney, Agent, or Firm*—Frank R. Niranjan

(57) ABSTRACT

A cooling fan assembly for an electronic apparatus includes a casing and first and second centrifugal fans for creating airflow through the casing to dissipate heat associated generated by the electronic apparatus. The casing has at least first and second air inlets and an air outlet. The first centrifugal fan is received in the casing and positioned proximate the air outlet, and the second centrifugal fan juxtaposed with the first centrifugal fan is also received in the casing and positioned proximate the air outlet and indirect fluid communication therewith. The first and second centrifugal fans and the casing further are configured such that the airflow is effectively induced to form a high-pressure volute tongue in a region bounded by the first and second centrifugal fans and the air outlet.

17 Claims, 5 Drawing Sheets

COOLING FAN ASSEMBLY FOR ELECTRIC APPARATUS

BACKGROUND OF THE INVENTION

1. Field of the Invention

The present invention relates to a cooling fan assembly for an electronic apparatus and, more particularly, to such a cooling fan assembly with low-noise characteristics.

2. Description of Related Art

It is well known that electronic elements such as semiconductors used in electronic apparatuses have been developed greatly. As the development of semiconductor devices increasingly progresses, the working performance and the computation speed are greatly enhanced. However, volumes of such semiconductor-based devices, such as central processing units (CPUs) or other electronic devices in, e.g., computer systems, also tend to become smaller and smaller. Due to the accelerated data processing speed, the accompanying working temperature may become significantly high. Such a high temperature is liable to degrade computation efficiency and even damage the electronic apparatuses, if allowed to go unchecked. In order to effectively lower the high working temperature, heat-dissipating devices (e.g., heat sinks and/or cooling fans) are generally required for CPUs and other electronic devices.

FIG. 5 (Prior Art) represents a conventional cooling fan assembly 4 for dissipating heat from an electronic apparatus (not shown). The cooling fan assembly 4 includes a casing 40 and a fan 42 accommodated therein. The casing 40 includes a volute tongue 400, an air inlet 402, a volute chamber 404, and an air outlet 406. The fan 42 is a centrifugal fan and includes a wheel 420 and a plurality of wheel blades 422 secured with the wheel 420.

The wheel blades 422 are driven by the wheel 420 and rotate counter clockwise. Airflow enters the cooling fan assembly 4 through the air inlet 402 and airflow is blown out by the wheel blades 422, through the air outlet 406. The airflow pressure is increased because the airflow impacts the volute tongue 400. The airflow blows along with the volute chamber 404 so that kinetic energy of the airflow converts to pressure energy and makes static pressure of the airflow great enough to surmount the air resistance outside the casing 40. Hereafter, most of the airflow directly blows outside the casing 40 through the air outlet 406, while the rest of the airflow is pushed, by the wheel blades 422, towards the volute tongue 400. An area adjacent the volute tongue 400 becomes a high-pressure area, while the area of the air outlet 406 is a low-pressure area. Thereby, it is reasonable that the airflow blows back from the volute tongue 400 to the air outlet 406. With the help of the cooling fan assembly 4, the airflow blowing out through the air outlet 406 cools the electronic apparatus to some degree. However, the cooling airflow that blows from the cooling fan assembly 4 is somewhat insufficient because only a single fan 42 is employed. Furthermore, high-level noise occurs because the airflow fiercely impacts the volute tongue 400, which is formed by part of the casing 40, i.e. it is tangible.

In order to overcome above-mentioned disadvantages which the cooling fan assembly 4 bearing, another conventional cooling fan assembly 6, as shown in FIG. 6 (Prior Art), is presented. The cooling fan assembly 6 includes a casing 60 and two centrifugal fans 62 and 64. The casing 60 is substantially symmetrically divided into a pair of volute chambers 602*a* and 602*b* by a partition 600. The casing 60 includes a pair of air inlets 604*a* and 604*b*, a pair of air outlets 606*a* and 606*b*, and a pair of volute tongues 608*a* and 608*b*. The pair of volute chambers 602*a* and 602*b* is independent of one another. The pair of air outlets 606*a* and 606*b* is juxtaposed at a same side of the casing 60, as well as the pair of the volute tongues 608*a* and 608*b*. The pair of centrifugal fans 62 and 64, respectively, is received in the pair of volute chambers 602*a* and 602*b* and adjacent to the pair of air outlets 606*a* and 606*b*. The centrifugal fan 62 includes a wheel 620 and a plurality of wheel blades 622 secured with the wheel 620. Similarly, the centrifugal fan 64 includes a wheel 640 and a plurality of wheel blades 642 secured with the wheel 640.

The centrifugal fan 62 rotates clockwise, and, on the contrary, the centrifugal fan 64 rotates counter clockwise. Airflow enters the casing 60 through the pair of air inlets 604*a* and 604*b* and then is pushed by the fans 62 and 64. Most of the airflow directly blows outside the casing 60 through the pair of air outlets 606*a* and 606*b*, respectively, yet the rest of the air is pushed towards the volute tongues 608*a* and 608*b* by the wheel blades 622 and 642. It is reasonable that the airflow blows back from the volute tongues 608*a* and 608*b* and to the air outlets 606*a* and 606*b*, respectively, because the area adjacent the volute tongues 608*a* and 608*b* are high-pressure areas, while the areas in which the air outlets 606*a* and 606*b* are located are low-pressure areas. Volumes of the airflow blowing to dissipate the heat associated with the correlative electrical apparatus are doubled since the cooling fan assembly 6 is furnished with a pair of fans 62 and 64.

However, the cooling fan assembly 6 is actually simply scrabbled up by the two single fans 62 and 64, since the partition 600 is configured for dividing the casing 60 into two individual portions. Although the volume of the airflow blowing out is doubled, the noise is still at a high level because the airflow fiercely impacts the pair of volute tongues 608*a* and 608*b* formed by parts of the casing 60.

Accordingly, what is needed is a cooling fan assembly, which readily dissipates heat from the electronic apparatus and does so with low-noise characteristics.

SUMMARY

A cooling fan assembly for an electronic apparatus includes a casing and first and second centrifugal fans configured for blowing airflow out to dissipate heat from the electric apparatus. The casing has first and second air inlets and an air outlet. The first centrifugal fan is received in the casing and is positioned against/proximate the air outlet directly, and the second centrifugal fan is juxtaposed with the first centrifugal fan is also received in the casing and positioned against/proximate the air outlet directly The first and second centrifugal fans and the casing further are configured such that the airflow is effectively induced to form a high-pressure volute tongue in a region bounded by the first and second centrifugal fans and the air outlet.

BRIEF DESCRIPTION OF THE DRAWINGS

Many aspects of the present cooling fan assembly can be better understood with reference to the following drawings. The components in the drawings are not necessarily to scale, the emphasis instead being placed upon clearly illustrating the principles of the present cooling fan assembly. Corresponding reference characters indicate corresponding parts throughout the several views.

Figure 1:
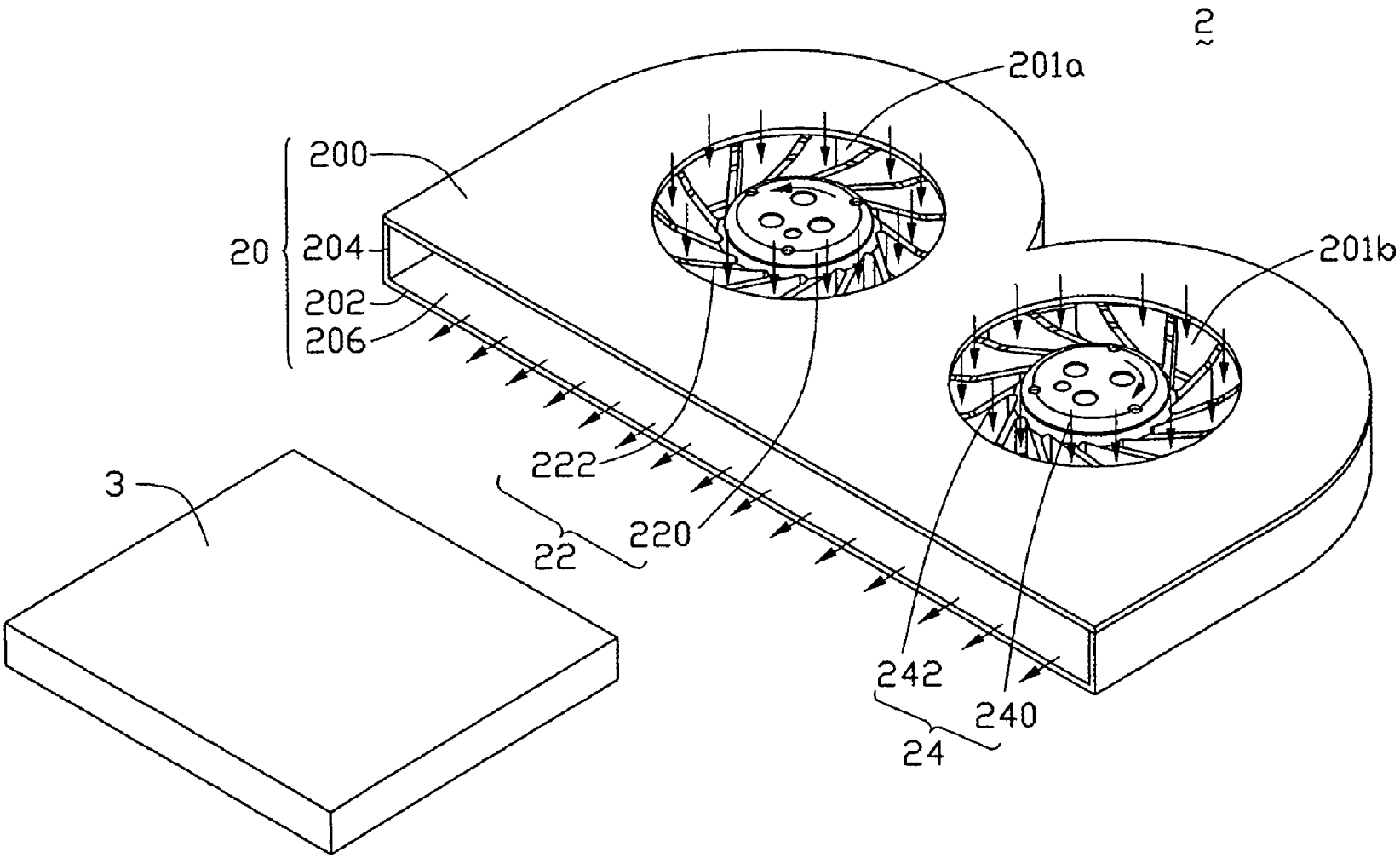
FIG. 1 is an isometric view of a cooling fan assembly for an electronic apparatus, in accordance with a preferred embodiment.

The exemplifications set out herein illustrate at least one preferred embodiment of the cooling fan assembly, in one form, and such exemplifications are not to be construed as limiting the scope of the cooling fan assembly in any manner.

DETAILED DESCRIPTION OF PREFERRED EMBODIMENTS

Reference will now be made to the drawing figures to describe, at least, the preferred embodiment of the present cooling fan assembly, in detail.

Figure 2:
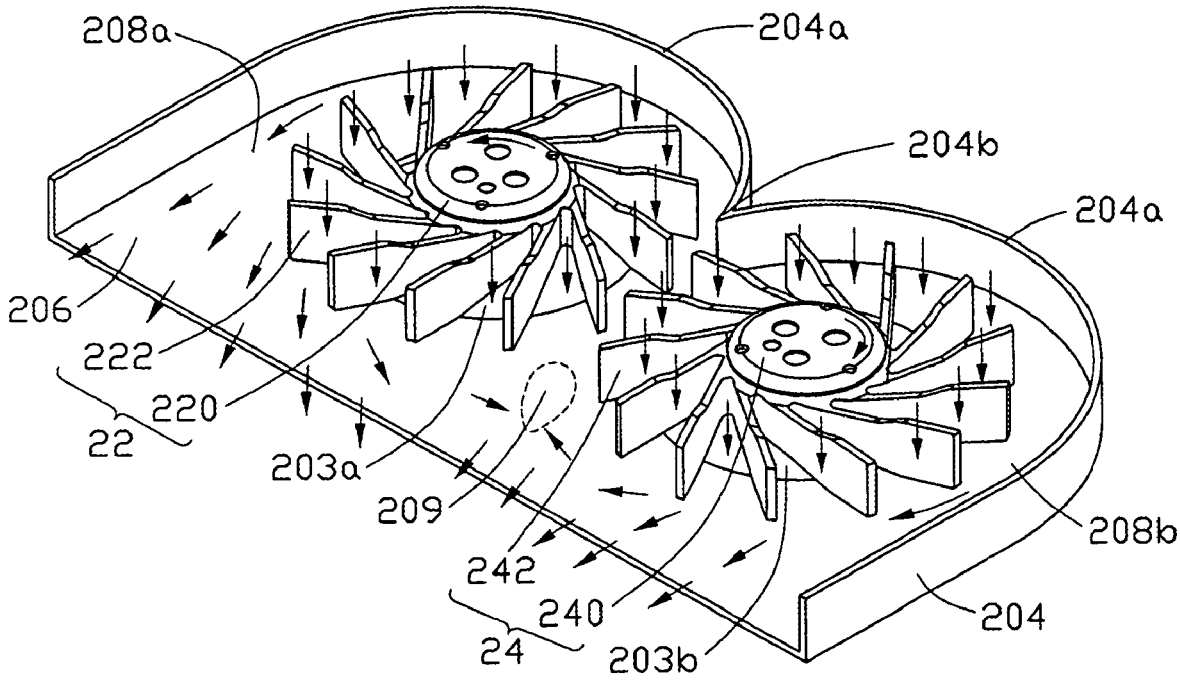
FIG. 2 is an isometric view of the cooling fan assembly of FIG. 1, with a cover of the cooling fan assembly being removed.

Referring to FIGS. 1 and 2, a cooling fan assembly 2 configured for dissipating heat from an electronic apparatus 3, according to a preferred embodiment, is illustrated. The cooling fan assembly 2 includes a casing 20 and a pair of centrifugal fans, named as first and second fans 22 and 24. The casing 20 has a cover 200, a bottom 202, and a sidewall 204. The cover 200, bottom 202, and sidewall 204 together define an air outlet 206 and first and second volute chambers 208*a*, 208*b*. First and second upper air inlets 201*a* and 201*b* are defined in the cover 200. First and second lower air inlets 203*a* and 203*b* are defined in the bottom 202 and are aligned with respect to the first and second upper air inlets 201*a* and 201*b*, respectively. The sidewall 204 extends upward from an edge of the bottom 202. The sidewall 204 interconnects the cover 200 with the bottom 202 so as to constitute the dual-arch shaped casing 20. The sidewall 204 creates a pair of volute arches 204*a* and an arch interconnection 204*b* for connecting the two volute arches 204*a*. The arch interconnection 204*b* and the air outlet 206 are located at two opposite sides of a line defined by two rotating axle centers of the first and second fans 22, 24, that same line further being substantially parallel to the air outlet 206.

The first fan 22 is received in the casing 20 and positioned proximate the air outlet 206. Meanwhile, the second fan 24, juxtaposed with the first fan 22, is also received in the casing 20 and positioned proximate the air outlet 206 and in direct fluid communication therewith. The first fan 22 includes a first wheel 220 and a plurality of first wheel blades 222 secured with the first wheel 220. Similarly, the second fan 24 also includes a second wheel 240 and a plurality of second wheel blades 242 secured with the second wheel 240. The first fan 22 rotates counter clockwise, while, on the contrary, the second fan 24 rotates clockwise. The rotation direction of the first and second fans 22, 24 is vis-à-vis each other at the position where there are nearest the air outlet 206.

The first and second fans 22, 24 are installed on the bottom 202, as shown, but additionally or alternatively could be mounted to the cover 200. The cover 200 is secured upon the sidewall 204. When the first fan 22 is positioned in the casing 20, the first upper air inlet 201*a*, the first fan 22 and the first lower air inlet 203*a* are coaxial. Similarly, the second upper air inlet 201*b*, the second fan 24 and the second lower air inlet 203*b* are also coaxial. Accordingly, the airflow enters the casing 20 through the first upper air inlets 201*a*, the first lower air inlet 203*a*, the second upper air inlets 201*b* and the second lower air inlet 203*b*.

When the cooling fan assembly 2 is put into use, the first and second fans 22, 24 rotate. The first and second wheel blades 222, 242 are driven, respectively, by the first and second wheels 220 and 240 to push and thereby blow out the air therein. The airflow portion created by the first wheel blades 220 is accelerated counter clockwise in the first volute chamber 208*a*. Meanwhile, the airflow portion driven by the second wheel blades 240 is accelerated clockwise. Most of the airflow directly flows outside the casing 20 through the air outlet 206. Yet, the rest of the airflow blows towards an intermediate section, encompassed by the first and second fans 22, 24 and further located near a center position of the air outlet 206, to form a volute tongue 209 of high pressure. The volute tongue 209 is fabricated with intangible air so that noise that may be induced by the airflow impacting the volute tongue 209 is greatly reduced. Because the volute tongue 209 is a high-pressure section, the airflow blows back/rebounds from the volute tongue 209 immediately impacting this high-pressure section, much of this rebounding airflow being redirected toward the air outlet 206. Thereby, the volume of the airflow blowing out through the air outlet 206 is substantially doubled. As such, the cooling fan assembly 2 very efficiently moves air through its overall assembly and is able to do so with a minimal amount of noise associated therewith.

Figure 3:
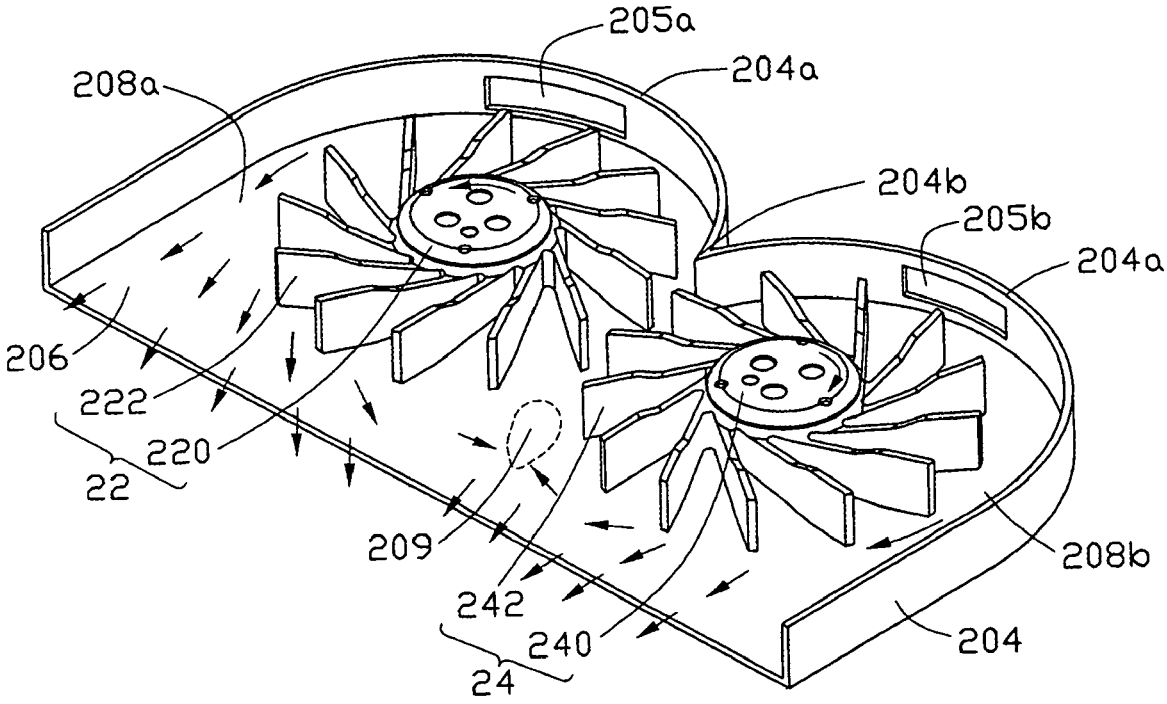
FIG. 3 is an isometric view of a cooling fan assembly for an electronic apparatus, in accordance with a second embodiment, with a cover of the cooling fan assembly being removed.
Figure 4:
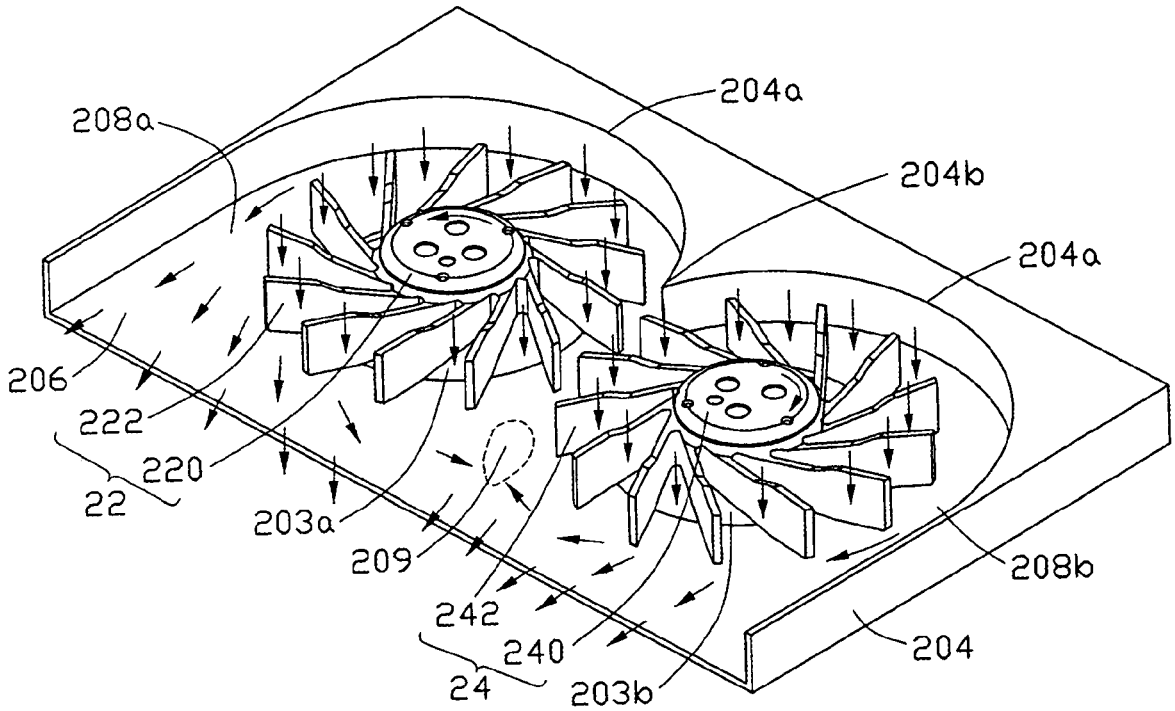
FIG. 4 is an isometric view of a cooling fan assembly for an electronic apparatus, in accordance with a third embodiment, with a cover of the cooling fan assembly being removed.
Figure 5:
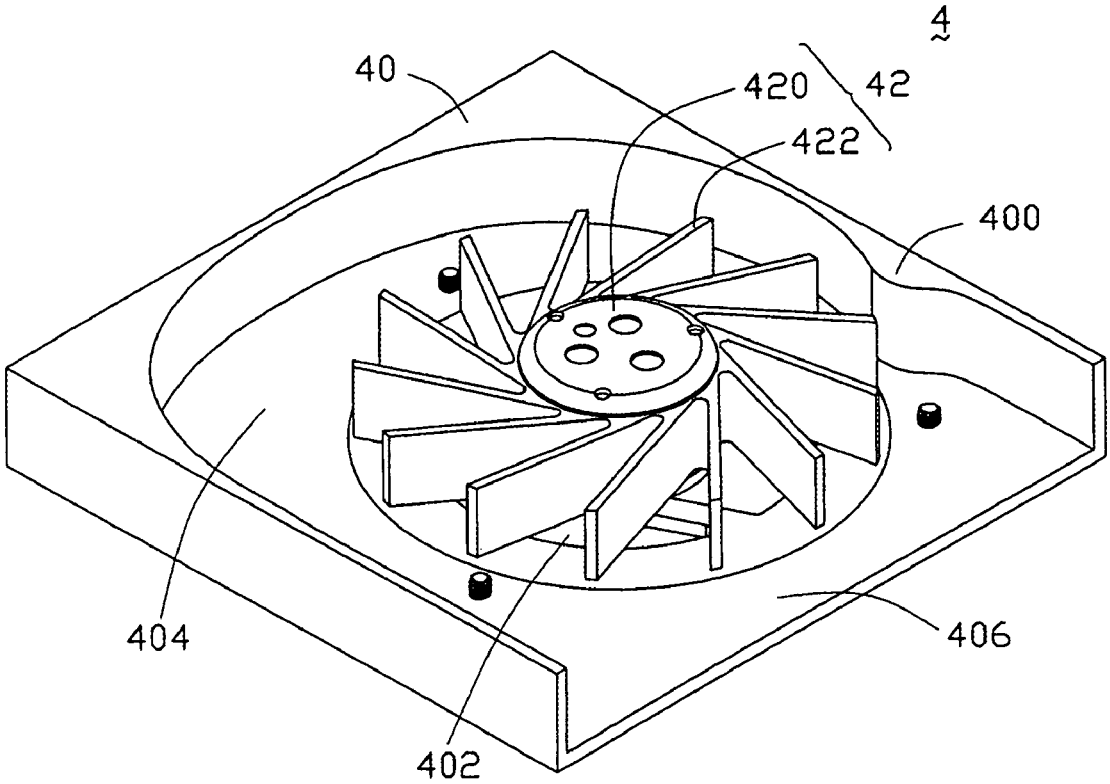
FIG. 5 (PRIOR ART)
FIG. 5 is an isometric view of a conventional cooling fan assembly for an electronic apparatus.
Figure 6:
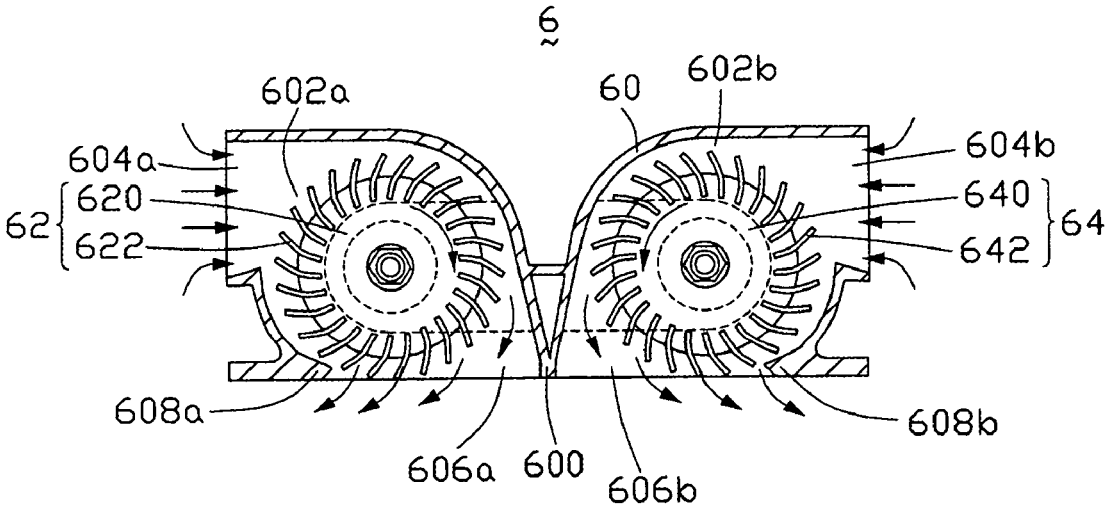
FIG. 6 (PRIOR ART)
FIG. 6 is an isometric view of another conventional cooling fan assembly for an electronic apparatus.

Referring also to FIGS. 3 and 4, alternative embodiments are illustrated therein. The airflow may be allowed to reach the first and second fans 22, 24 along one or more radial directions of the first and second wheels 220, 240, in addition to or instead of the axial direction. The air inlets 205*a*, 205*b* may be defined in the sidewall 204, thus promoting radial entry of air. The exterior of the casing 20 adjacent the two arches 204*a* may be constructed as plane, while two arches 204*a* are still reserved in the interior of the casing 20. The casing 20 may be integrally shaped instead of being manufactured separately.

Although the present invention has been described with reference to specific embodiments, it should be noted that the described embodiments are not necessarily exclusive. As such, various changes and modifications may be made to the described embodiments without departing from the scope of the invention as defined by the appended claims.

We claim:

1. A cooling fan assembly for an electronic apparatus, comprising:

a casing having a sidewall and at least first and second air inlets and an air outlet, wherein:

the sidewall comprises:

two volute arches respectively corresponding to the first and second air inlets, each of the two volute arches comprising an arc inner surface and a flat inner surface having a tangent connection with the arc inner surface; and an arch interconnection connecting the arc inner surfaces of the two volute arches; and two flat inner surfaces of the sidewall are also two parts of an enclosure defining the air outlet;

a first centrifugal fan received in the casing and positioned proximate the air outlet; and a second centrifugal fan received in the casing, the second centrifugal fan being juxtaposed with the first centrifugal fan and positioned proximate the air outlet, the first and second centrifugal fans being configured for creating an airflow through the casing, the first and second centrifugal fans and the casing further being configured such that the airflow is effectively induced to form a high-pressure volute tongue in a region bounded by the first and second centrifugal fans and the air outlet.

2. The cooling fan assembly as described in claim 1, wherein the volute tongue is configured for promoting a redirection of the airflow impacting thereupon, such redirection of airflow tending to be oriented toward the air outlet.

3. The cooling fan assembly as described in claim 2, wherein the rotation direction of the first and second fans is vis-à-vis each other at the position where there are nearest the air outlet.

4. The cooling fan assembly as described in claim 1, wherein the casing further comprises a cover and a bottom, the sidewall being located along the side of the bottom, the cover being laid over the sidewall, the casing thereby being configured for establishing a space to install the first and second centrifugal fans therein.

5. The cooling fan assembly as described in claim 4, wherein the interior of the casing defines a pair of volute chambers, each volute chamber being configured for accelerating the airflow in the casing.

6. The cooling fan assembly as described in claim 4, wherein both the two arc inner surfaces and the arch interconnection are opposite to the air outlet.

7. The cooling fan assembly as described in claim 4, wherein the first and second air inlets are defined in the cover.

8. The cooling fan assembly as described in claim 4, wherein the first and second air inlets are defined in the bottom.

9. The cooling fan assembly as described in claim 1, wherein the first and second air inlets are defined in the sidewall.

10. A cooling fan assembly, comprising:

a cover, a bottom, and a sidewall together defining a first and second volute chambers; and a first and second centrifugal fans respectively received in the first and second volute chambers;

wherein the sidewall comprises:

two volute arches respectively corresponding to the first and second volute chambers, each of the two volute arches comprising an arc inner surface and a flat inner surface having a tangent connection with the arc inner surface;

an arch interconnection connecting the arc inner surfaces of the two volute arches; and the two flat inner surfaces of the sidewall, the cover, and the bottom together defining an air outlet.

11. The cooling fan assembly as described in claim 10, wherein a first continuous space is defined between one of the flat inner surfaces and the first centrifugal fan such that airflow generated by the first centrifugal fan can flow smoothly through the first continuous space, and a second continuous space is defined between the other one flat inner surface and the second centrifugal fan such that airflow generated by the second centrifugal fan can flow smoothly through the second continuous space.

12. The cooling fan assembly as described in claim 10, wherein the first and second centrifugal fans are configured for creating an airflow, the first and second centrifugal fans and the casing further being configured such that the airflow is effectively induced to form a high-pressure volute tongue in a region bounded by the first and second centrifugal fans and the air outlet.

13. The cooling fan assembly as described in claim 10, wherein a first and second air inlets are respectively defined in the cover above the first and second centrifugal fans.

14. The cooling fan assembly as described in claim 10, wherein a first and second air inlets are respectively defined in the bottom below the first and second centrifugal fans.

15. The cooling fan assembly as described in claim 10, wherein a first and second air inlets are respectively defined in the sidewall near the first and second centrifugal fans.

16. The cooling fan assembly as described in claim 10, wherein the arc inner surfaces of the two volute arches and the arch interconnection are opposite to the air outlet.

17. The cooling fan assembly as described in claim 10, wherein the first and second air inlets are respectively defined in the two volute arches of the sidewall.

* * * * *